US006179042B1

(12) United States Patent
Perdue et al.

(10) Patent No.: US 6,179,042 B1
(45) Date of Patent: Jan. 30, 2001

(54) NON-HOT CRACK BOTTOM BLOCK FOR CASTING ALUMINUM INGOT

(75) Inventors: Rick D. Perdue; Carl R. Reagin, both of Lafayette, IN (US); S. John Pien, Export, PA (US); Raymond T. Richter; Ho Yu, both of Murrysville, PA (US)

(73) Assignee: Alcoa Inc., Pittsburgh, PA (US)

( * ) Notice: Under 35 U.S.C. 154(b), the term of this patent shall be extended for 0 days.

(21) Appl. No.: 09/316,623

(22) Filed: May 21, 1999

(51) Int. Cl.[7] ..... B22D 11/08; B22D 11/049

(52) U.S. Cl. ..... 164/483; 164/425; 164/445; 164/487

(58) Field of Search ..... 164/525, 426, 164/445, 446, 483, 487

(56) References Cited

U.S. PATENT DOCUMENTS

| | | | | |
|---|---|---|---|---|
| 944,370 | | 12/1909 | Monnot . | |
| 1,335,685 | | 3/1920 | Howard et al. . | |
| 2,093,024 | | 9/1937 | Williams | 22/139 |
| 3,384,152 | | 5/1968 | Olsen et al. | 164/274 |
| 3,608,619 | | 9/1971 | Bollig et al. | 164/274 |
| 3,682,435 | | 8/1972 | Lofberg et al. | 249/204 |
| 3,702,152 | | 11/1972 | Bryson | 164/89 |
| 3,702,631 | | 11/1972 | Sergerie | 164/274 |
| 3,847,206 | | 11/1974 | Foye | 164/274 |
| 3,948,310 | | 4/1976 | Deschapelles | 164/274 |
| 3,957,105 | | 5/1976 | Foye | 164/274 |
| 4,097,019 | | 6/1978 | Connors | 249/204 |
| 4,274,470 | * | 6/1981 | Yarwood et al. | 164/483 |
| 4,509,580 | | 4/1985 | Goodrich | 164/445 |
| 4,567,935 | | 2/1986 | Takeda et al. | 164/450 |
| 4,940,075 | | 7/1990 | Kubon et al. | 164/446 |
| 4,987,750 | | 1/1991 | Yu | 164/455 |
| 5,217,060 | | 6/1993 | Lazzaro | 164/425 |
| 5,634,511 | | 6/1997 | Steen et al. | 764/425 |
| 5,709,260 | | 1/1998 | Wagstaff et al. | 164/453 |

FOREIGN PATENT DOCUMENTS

| | | | | |
|---|---|---|---|---|
| 510309 | * | 6/1976 | (SU) | 164/425 |

* cited by examiner

*Primary Examiner*—Kuang Y. Lin
(74) *Attorney, Agent, or Firm*—David W. Pearce-Smith

(57) ABSTRACT

An improved cylindrical bottom block for casting of large ingots or billets, particularly cylindrical shaped ingots, of light metals, such as aluminum and aluminum alloys, the cylindrical bottom comprising: (a) a base section having an outer diameter; (b) a centrally located circular surface forming the upper end of the base section, the circular surface positioned substantially perpendicular to the direction of casting, the circular surface forming the floor of the dish of the cylindrical bottom block which receives and cools liquid phase metal to form the butt end of an ingot, the circular surface being substantially flat and having a peripheral edge; (c) a cylindrical rim extending around the peripheral edge of the centrally located circular surface, the rim having an upper edge and an inner side wall which forms the side wall of the dish; (d) a concave transition section positioned between the peripheral edge and the lower end of the inner side wall, the concave transition section extending completely around the peripheral edge of the dish; (e) a convex transition section between the upper edge of the rim and the upper end of the inner side wall, the convex transition section extending completely around the dish; (f) the inner side wall having a flat central surface extending completely around the dish and defining the inner diameter of the dish; and (g) the upper edge of the rim having a flat surface positioned substantially parallel to the centrally located circular surface, the upper edge extending around the dish.

26 Claims, 2 Drawing Sheets

NON-HOT CRACK BOTTOM BLOCK FOR CASTING ALUMINUM INGOT

TECHNICAL FIELD

The present invention relates to methods and apparatus for level pour or hot top casting of large ingots or billets, particularly cylindrical shaped ingots, of light metals, such as aluminum and aluminum alloys. As used herein, the term "aluminum" includes both pure aluminum and aluminum alloys.

BACKGROUND ART

In conventional level pour or hot top casting, molten metal is poured into the feed end of an open-ended tubular mold and solidified or partially solidified metal exits from the discharge end of the mold. The mold itself is cooled by a body of coolant maintained at the backside of the mold by means of a water jacket. Coolant, usually water or water fortified with dissolved gas, is applied around the periphery of the ingot as it exits from the mold to effect solidification. In the casting of light metals, such as aluminum, coolant is usually directed by means of one or more baffles from the body of coolant in the water jacket down the backside of the mold and out suitable slots or conduits at the bottom of the mold onto the ingot exiting the discharge end of the mold.

Electromagnetic (EM) casting is similar to the above-described conventional level pour or hot top casting except that the lateral shape of the molten metal is controlled by electromagnetic pressure generated by the annular inductor surrounding the column of molten metal, rather that the bore of the mold as in conventional level pour or hot top casting.

In vertical level pour or hot top casting and EM casting, a bottom block is positioned within the discharge end of the mold (for level pour or hot top casting) or within the discharge end of the electromagnetic inductor (for EM casting) to close off the discharge opening and to hold the molten metal until it has solidified enough to maintain its final desired shape. When the metal has been sufficiently solidified, the bottom block is lowered out of the discharge end of the mold or inductor to allow the solidified ingot to be discharged from the mold or inductor in a continuous or semi-continuous fashion. Once the withdrawal of the bottom block begins, the drop rate thereof is usually maintained at a constant level until the end of the cast, because any sudden change in the drop rate can result in changes in the cross-sectional dimensions of the solidified ingot along the length thereof and can cause serious surface defects on the ingot.

In conventional level pour or hot top casting, there is very little, and in EM casting, there is essentially no horizontal support of the solidified ingot in its downward descent, so the ingot must be well balanced on the bottom block to avoid rocking or leaning off center. However, as the butt of the ingot solidifies and cools, the ingot shrinks. The bottom face of the forming ingot in contact with the bottom block begins to curl away from the surface of the bottom block as the metal begins to solidify and contract. Frequently, as the butt end of the ingot begins to curl away from the top of the bottom block, the forming ingot shell will not be sufficiently strong to support itself and one side of the ingot will start to collapse and a crack may form at the stress point at the edge of the butt which can ultimately extend the entire length of the ingot and thereby require its scrapping.

The formation of dish-shaped butts is a significant problem in casting with bottom blocks, especially in casting alloys having an intermediate size melting range (e.g., 35°–200° F., particularly 40°–140° F.). With relatively pure alloys, such as 1100 (Aluminum Association alloy designation), the melting range is so narrow that rapid solidification of the butt is assured under normal casting conditions, thereby minimizing the chances of forming a dish-shaped butt. On the other hand, with highly alloyed materials, even though the temperature range between the solidus and liquidus points is broad, the strength of the forming ingot due to the alloying constituents is sufficiently high to preclude the formation of dish-shaped butts.

A typical prior art bottom block are shown in U.S. Pat. Nos. 3,948,310, 4,509,580 and 4987,950.

Accordingly, it would be advantageous to provide an economical and effective bottom block for casting and method of casting metal that results in less residual stress and cracking in the ingot.

The primary object of the present invention is to provide a method and bottom block for casting metal that results in less residual stress and cracking in the ingot.

Another object of the present invention is to provide a method and bottom block for casting metal that results in less residual stress and cracking in the ingot without water cooling the bottom block.

These and other objects and advantages of the present invention will be more fully understood and appreciated with reference to the following description

SUMMARY OF THE INVENTION

An improved cylindrical bottom block or casting of large ingots or billets, particularly cylindrical shaped ingots, of light metals, such as aluminum and aluminum alloys, the cylindrical bottom comprising: (a) a base section having an outer diameter; (b) a centrally located circular surface forming the upper end of the base station, the circular surface positioned substantially perpendicular to the direction of casting, the circular surface forming the floor of the dish of the cylindrical bottom block which receives and cools liquid phase metal to form the butt end of an ingot, the circular surface being substantially flat and having a peripheral edge; (c) a cylindrical rim extending around the peripheral edge of the centrally located circular surface, the rim having an upper edge and an inner side wall which forms the side wall of the dish; (d) a concave transition section positioned between the peripheral edge and the lower end of te inner side wall, the concave transition section extending completely around the peripheral edge of the dish; (e) a convex transition section between the upper edge of the rim and the upper end of the inner side wall, the convex transition section extending completely around the dish; (f) the inner side wall having a flat central surface extending completely around the dish and defining the inner diameter of the dish; and (g) the upper edge of the rim having a flat surface positioned substantially parallel to the centrally located circular surface, the upper edge extending around the dish.

Another aspect of the present invention is a method for continuously casting ingots of aluminum, magnesium or their alloys comprising: (1) providing an open-ended mold; (2) providing a bottom block within the open-ended mold, the bottom block comprising: (a) a base section having an outer diameter; (b) a centrally located circular surface forming the upper end of the base section, the circular surface positioned substantially perpendicular to the direction of casting, the circular surface forming the floor of the dish of the cylindrical bottom block which receives and cools liquid phase metal to form the butt end of an ingot, the circular surface being substantially flat and having a peripheral edge; (c) a cylindrical rim extending around the peripheral edge of the centrally located circular surface, the rim having an upper edge and an inner side wall which forms the side wall of the dish; (d) a concave transition section positioned between the peripheral edge and the lower end of the inner side wall, the concave transition section extending completely around the peripheral edge of the dish; (e) a convex transition section between the upper edge of the rim and the upper end of the inner side wall, the convex transition section extending completely around the dish; (f) the inner side wall having a flat central surface extending completely around the dish and defining the inner diameter of the dish; and (g) the upper edge of the rim having a flat surface positioned substantially parallel to the centrally located circular surface, the upper edge extending around the dish; (3) substantially continuously introducing molten metal into the open-ended mold; (4) continuously applying liquid cooling medium to the open-ended mold to effectuate at least partial solidification of the molten metal therein; and (5) continuously withdrawing the bottom block from the open-ended mold to form an ingot, the ingot having its periphery, at least, solidified, while simultaneously directing liquid cooling medium comprising water to the exterior surfaces of the ingot emerging from the mold to extract heat therefrom.

BRIEF DESCRIPTION OF THE DRAWINGS

Other features of the present invention will be further described in the following related description of the preferred embodiment which is to be considered together with the accompanying drawings wherein like figures refer to like parts and further wherein.

MODE FOR CARRYING OUT THE INVENTION

Figure 1:
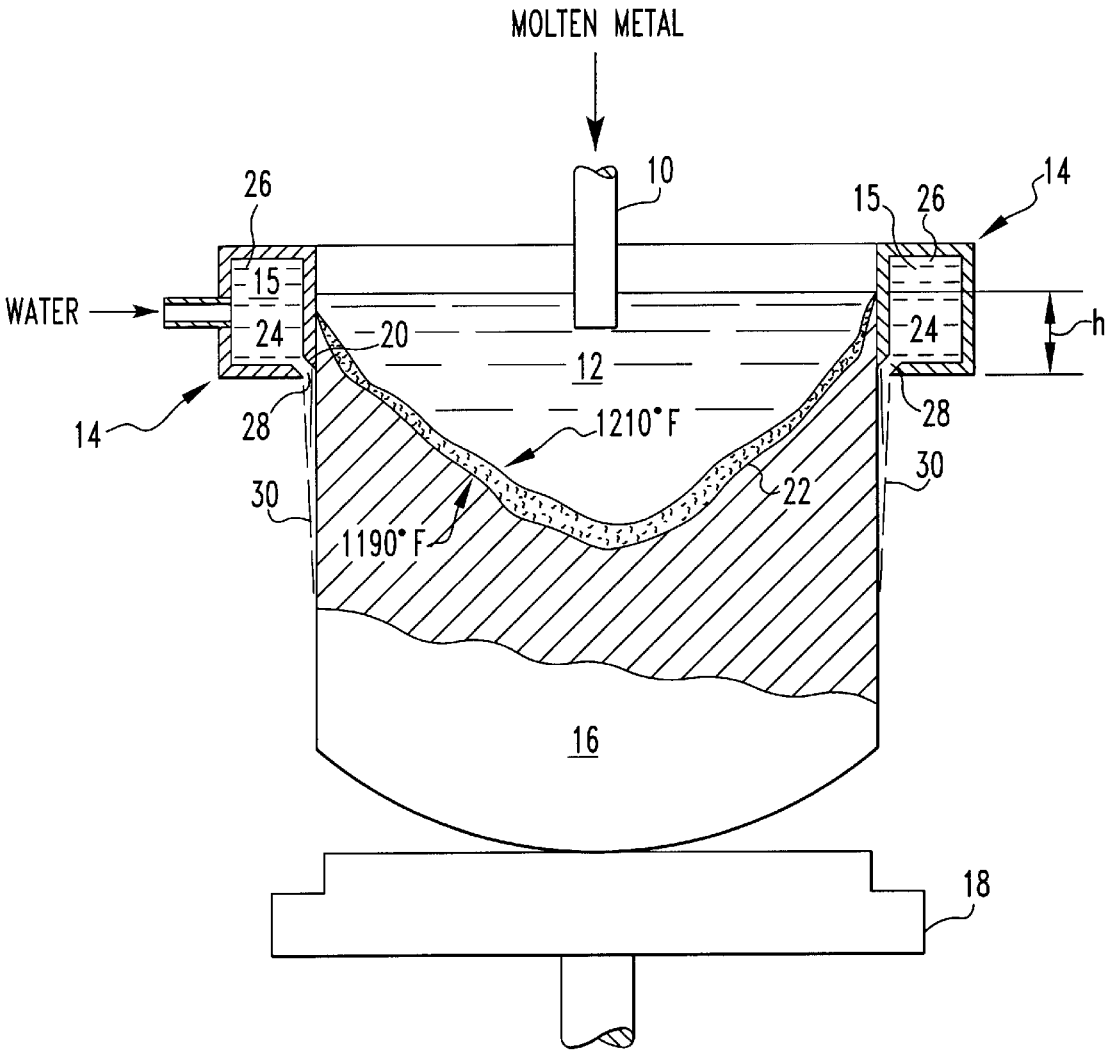
FIG.1 (PRIOR ART)
FIG. 1 is an elevation view, partially in cross section, illustrating a typical unit used for continuously cast ingots.

FIG. 1 illustrates a typical apparatus used for continuously casting ingots. The apparatus shown in FIG. 1 generally includes a pouring spout 10 for molten metal 12. However, pouring spouts are not required. Casting mold 14 generally defines the transverse dimensions of the ingot 16 being cast. The apparatus also includes a vertically movable bottom block 18 which closes the lower end of the mold 14 at the beginning of the casting operation and by its descent determines the rate at which the ingot 16 is advanced from the mold 14.

In order to insure that the continuous casting operation is understood, a few definitions should be provided at the outset.

Metal "head" is defined as the distance the ingot shell travels in mold 14 before it emerges from bottom 20 of mold 14. Head is measured from the meniscus of the molten metal in mold 14 to the bottom or end 20 of mold 14. Head is illustrated in FIG. 1 by dimension "h". "Crater" is the term used to define the molten metal pool which exhibits an inverted, generally wedge-shaped configuration from the meniscus of the molten metal level in mold 14 to a location some distance from exit end 20 of mold 14, which is centrally located in the ingot 16. Although the cross-sectional crater profile is often illustrated as a solid line separating molten metal from solid metal, it will be understood by those skilled in the art that there is a mushy zone 22, where the metal is not fully solid and not really liquid, separating the molten and solid phases. For aluminum ingot, such as Aluminum Association Alloy 3003, the mushy zone exists where the metal exhibits a temperature of from about 1190° F. (643° C.) to about 1210° F. (656° C.), and for Aluminum Association Alloy 3004, the mushy zone exists where the metal temperature ranges from about 1165° F. (629° C.) to about 1210° F. (656° C.).

In the typical continuous casting process, molten metal may be transferred to the casting unit directly from a furnace or from a melting crucible. The molten metal is poured through a pouring spout 10 or the like into a mold 14 having its bottom closed by a bottom block 18. Flow control devices (not shown) may be provided to minimize cascading and turbulent metal flow and to insure even metal distribution.

Mold 14 is externally cooled, usually with a liquid cooling medium such as water. Constructing the mold of a material having high thermal conductivity, such as aluminum or copper, insures that the coolant temperature is transferred as efficiently as possible through inner mold wall 24 to the metal to effect solidification.

The coolant, typically water, used for direct cooling in the continuous casting unit illustrated in FIG. 1 is provided from the same supply used to cool mold 14. It should be understood that a more flexible cooling arrangement can be obtained from dual cooling, wherein the water supply to the mold is separate from the water supply to the ingot. In the vertical casting unit illustrated in FIG. 1, water 15 is pumped under pressure into hollow passageway 26 within the mold at a rate of approximately 200 to 350 gallons (757 to 1325 liters) per minute. As long as the water temperature is less than about 90° F. (32° C.) and greater than about 32° F. (0° C.), cooling efficiency is not significantly affected. The water fills passageway 26 and is fed through multiple orifices 28 spaced around mold 14 and extending through the lower inside comer of mold 14. Orifices 28 are constructed and spaced such that the cooling water fed therethrough is directed against the exterior surfaces of ingot 16 forming a uniform blanket of water 30 about the emerging portion of the ingot.

At the initiation of a casting sequence, as the molten metal is poured into the closed, water-cooled mold 14, the metal temperature quickly drops to not much above the liquidus. When there has been sufficient peripheral solidification of ingot 16, bottom block 18 is lowered. Those skilled in the art recognize that the major cooling effect remains outside the mold by direct cooling. Coolant contact during direct cooling must be proper to insure uniformity. Proper contact requires that the direction, rate and pressure of the coolant be relatively constant. Uneven contact will cause uneven heat flow conditions which may adversely affect ingot quality. Light metals, such as aluminum, magnesium and particularly Aluminum Association Alloys are found particularly adapted to the method of the present invention.

At the beginning of the continuous casting operation, bottom block 18 is lowered at a slow rate. Starting casting rates of about 1.5 to 2.5 inches (38.1 to 63.5 mm) per minute are common. After an ingot has emerged about 2 to 5 inches (50.8 to 127.0 mm) from the mold, the casting rate may be increased. Running casting rates of 2 to 6 inches (50.8 to 152.4 mm) per minute are typical.

Metal head during continuous casting is usually held as constant as possible. A head of from about 1.25 to 1.75 inches (31.75 to 44.45 mm) is considered a low head, while a head of from about 2.5 to 3.5 inches (63.5 to 88.7 mm) is considered a normal head. A variable head, which starts normal and after start-up is run low, may be preferred for certain ingots having high width to thickness ratios because of their difficulty in starting. From an economical and increased production rate viewpoint, it is more efficient to start and run with a low head.

Figure 2:
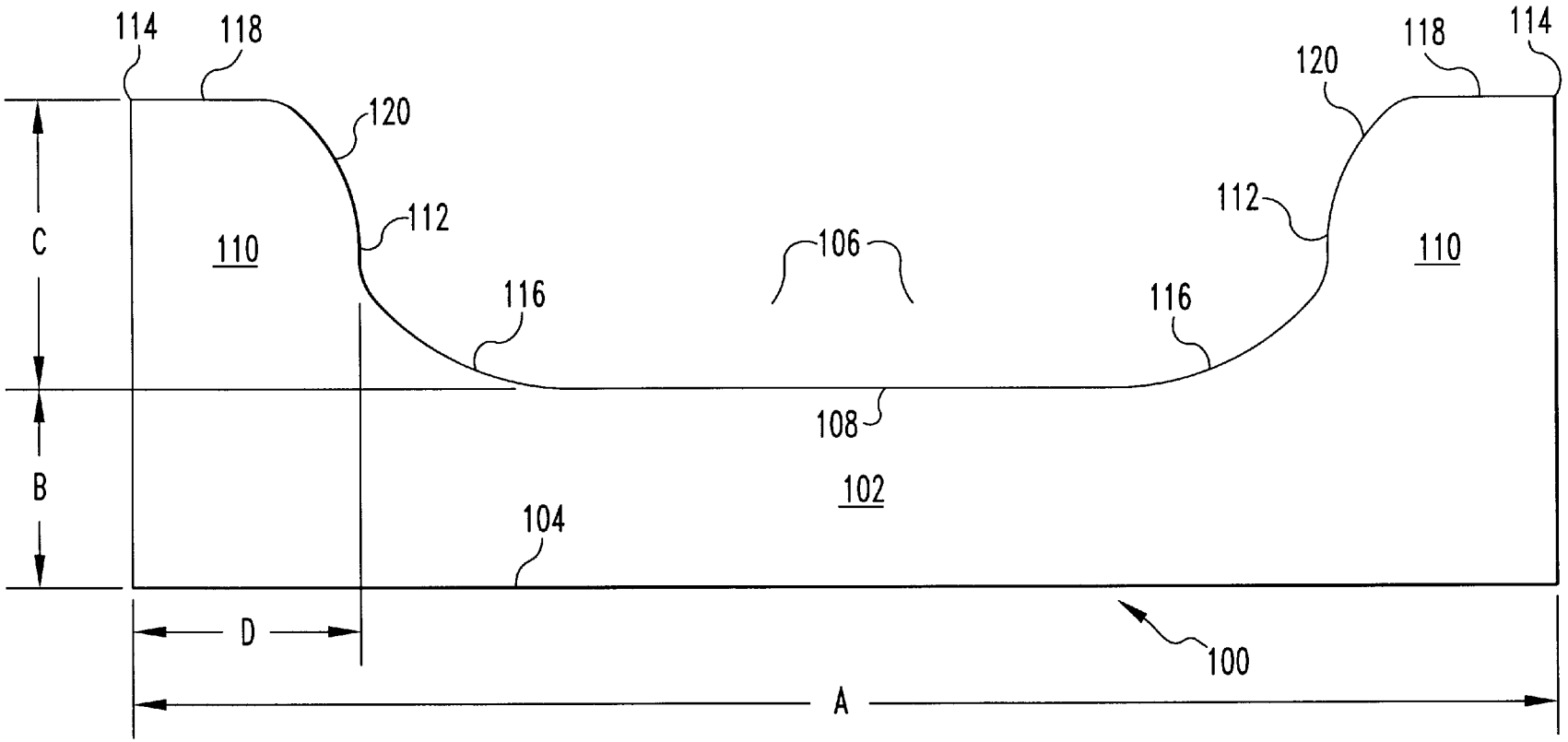
FIG. 2 is a cross-sectional view of an improved bottom block of the present invention.

Turning next to FIG. 2, there is illustrated a cross-sectional view of an improved bottom block 100 of the present invention. Bottom block 100 is made of steel, aluminum, or a material that is more refractory than aluminum. Bottom block 100 is symmetrical and has a base 102 with a lower surface 104, and a dish section 106 located at the end opposite lower surface 104. In operation molten metal will fill dish section 106.

Lower surface 106 is circular and substantially perpendicular to the direction of casting.

Base 102 has a diameter A. Diameter A varies in length according to the size of the ingot that is to be cast. Diameter A has no lower limit, but the improved design has been proven to be useful for diameters larger than 15 inches.

Those skilled in the art recognize that for small diameter ingots, thermal cracking is not a significant problem. The larger the ingot, the greater the likelihood of cracking. Surprisingly, the bottom block of the present invention has been used to successfully cast ingots having a diameter of 42 inches. It is expected that the ingot of the present invention could be used to cast ingots having a diameter A which is significantly greater than 42 inches. Diameters A of 60 inches and 72 inches are believed to be possible with the present invention. To date, no attempts have been made to cast ingots having diameters greater than 42 inches using the present invention.

Base 102 has a thickness B which can vary with diameter A. Thickness B is from about 25% to about 60% of the total height of bottom block 100. Typically, thickness B can be 3 to 8 inches or more.

Dish section 106 is formed generally by floor 108 and rim 110. Floor 108 is circular and centered in the middle diameter A. Floor 108 has a length which is from about 20% to about 60% of diameter A. In a preferred embodiment, floor 108 has a length which is from about 35% to about 58% of diameter A.

In addition, floor 108 is substantially perpendicular to the direction of casting. In operation, as molten metal contacts floor 108, it spreads symmetrically to fill dish section 106, and bottom block 100 cools molten metal to form the butt end of an ingot (not shown).

Rim 110 forms the side wall of dish section 106 and has a flat side section 112 that is substantially parallel to the direction of casting. The slope of flat side section 112 can vary from sloping upward and outward by an angle of about 0.01° to about 30.0° from the direction of casting to a slope which is upward and inward having an angle of about 0.01° to about 10.0° from the direction of casting. Preferably, the slope of flat side section 112 can vary from sloping upward and outward by an angle of about 0.01° to about 10.0° from the direction of casting to a slope which is upward and inward having an angle of about 0.01° to about 5.0° from the direction of casting.

Rim 110 has a height C that extends from floor 108 to an upper edge 114. Height C will vary with length of diameter A. Larger diameter ingots require higher rims. Height C is from about 40% to about 75% of the total height of bottom block 100. Typically, height C will be 2 to 10 inches or more.

Rim 110 has a thickness D which varies with the size of the ingot that is being cast. Typically, thickness D is about 10% to about 30% of Diameter A. In a preferred embodiment, thickness D is about 10% to about 25% of Diameter A.

Between floor 108 and rim 110 there is a concave surface 116 which extends completely around circular floor 108. Concave surface 116 provides a sloping transition from floor 108 to rim 110. In a preferred embodiment, concave surface 116 is an arc from a circle having a radius of from about 1 to 5 inches or an arc from an ellipse. Concave surface 116 extends from about 5% to about 18% of diameter A.

Upper edge 114 of rim 110 forms the uppermost surface of bottom block 100. In a preferred embodiment, upper edge 114 has a flat rim section 118 which is substantially perpendicular to the direction of casting and therefore substantially parallel to floor 108. The slope of flat rim section 118 can vary from sloping downward and outward by an angle of about 0.01° to about 10.0° from the direction perpendicular to the direction of casting to a slope which is upward and outward having an angle of about 0.01° to about 15.0° from the direction perpendicular to the direction of casting.

In addition, flat rim section 118 extends from about 5% to about 20% of diameter A. In a preferred embodiment, flat rim section 118 extends from about 5% to about 15% of diameter A.

Between floor 108 and upper edge 114, there is a convex surface 120 which provides a sloping transition from flat side section 112 to flat rim section 118. Convex surface 120 extends completely around bottom block 100. Typically, a convex surface is an arc from a circle having a radius of from about 1 to 5 inches or an arc from an ellipse. In a preferred embodiment, convex surface 120 extends from about 4% to about 18% of diameter A.

Surprisingly, it has been found that the bottom block of the present invention reduces the incidence of cracking in casting large cylindrical ingots. As a general rule of thumb, the larger the size of the ingot the greater the likelihood that the ingot will crack. Using the bottom block of the present invention, ingot sizes of 22, 30 and 42 inches in diameter have been successfully cast.

Although not wishing to be bound by any theory, it is believed that the bottom block design of the present invention works because it reduces the radial stresses in the ingot that form during solidification.

It is to be appreciated that certain features of the present invention may be changed without departing from the present invention. Thus, for example, it is to be appreciated that although the invention has been described in terms of a preferred embodiment in which there is a flat rim section 118, it is not a necessary feature of the invention.

Whereas the preferred embodiments of the present invention have been described above in terms of casting a cylindrical ingot, those skilled in the art will recognize that that design of the present invention can be used for other shapes. Those skilled in the art will recognize that the present invention reduces the radial stresses in the ingot and that the design can be modified for rectangular ingot.

Whereas the preferred embodiments of the present invention have been described above in terms of being especially valuable in casting aluminum alloy ingots, it will be apparent to those skilled in the art that the present invention will also be valuable in producing parts made of other metals. Among such suitable metals for casting are steel, copper, magnesium and titanium.

It is also to be appreciated that although the invention has been described in terms of casting metal, the method and apparatus of the present invention may also be employed with metal matrix composites, metal laminates and cermets.

What is believed to be the best mode of the invention has been described above. However, it will be apparent to those skilled in the art that numerous variations of the type described could be made to the present invention without departing from the spirit of the invention. The scope of the present invention is defined by the broad general meaning of the terms in which the claims are expressed.

What is claimed is:

1. In a continuous casting apparatus wherein an improved cylindrical bottom block for casting of large ingots or billets, particularly cylindrical shaped ingots, of light metals, such as aluminum and aluminum alloys, said cylindrical bottom comprising:

(a) a base section having an outer diameter;

(b) a centrally located circular surface forming the upper end of said base section, said circular surface positioned substantially perpendicular to the direction of casting, said circular surface forming the floor of the dish of the cylindrical bottom block which receives and cools liquid phase metal to form the butt end of an ingot, said circular surface being substantially flat and having a peripheral edge;

(c) a cylindrical rim extending around said peripheral edge of said centrally located circular surface, said rim having an upper section and an inner side wall which forms the side wall of said dish;

(d) a concave transition section positioned between said peripheral edge and the lower end of said inner side wall, said concave transition section extending completely around said peripheral edge;

(e) a convex transition section between said upper section of said rim and the upper end of said inner side wall, said convex transition section extending completely around said dish;

(f) said inner side wall having a flat central surface extending completely around said dish and defining the inner diameter of said dish; and (g) said upper section of said rim having an upper edge extending around said dish.

2. The improved cylindrical bottom block of claim 1 in which said base section extends from about 25% to about 60% of the height of said bottom block.

3. The improved cylindrical bottom block of claim 1 in which said centrally located circular surface extends from about 40% to about 60% of said outer diameter of said bottom block.

4. The improved cylindrical bottom block of claim 1 in which said centrally located circular surface extends from about 45% to about 58% of said outer diameter of said bottom block.

5. The improved cylindrical bottom block of claim 1 in which said cylindrical rim extends from about 10% to about 30% of said outer diameter of said bottom block.

6. The improved cylindrical bottom block of claim 1 in which said cylindrical rim extends from about 10% to about 25% of said outer diameter of said bottom block.

7. The improved cylindrical bottom block of claim 1 in which said cylindrical rim extends from about 40% to about 75% of the height of said bottom block.

8. The improved cylindrical bottom block of claim 1 in which said concave transition section has an arc which is a section of a circle.

9. The improved cylindrical bottom block of claim 1 in which said concave transition section has an arc which is a section of a circle having a length of from about 8% to about 16% of said outer diameter of said bottom block.

10. The improved cylindrical bottom block of claim 1 in which said concave transition section has an arc which is a section of a circle having a length of from about 9% to about 15% of said outer diameter of said bottom block.

11. The improved cylindrical bottom block of claim 1 in which said convex transition section has an arc which is a section of a circle.

12. The improved cylindrical bottom block of claim 1 in which said convex transition section has an arc which is a section of a circle having a length of from about 4% to about 16% of said outer diameter of said bottom block.

13. The improved cylindrical bottom block of claim 1 in which said upper section has a substantially flat portion.

14. The improved cylindrical bottom block of claim 1 in which said upper section has a substantially flat portion which extends from about 8% to about 12% of said outer diameter of said bottom block.

15. The improved cylindrical bottom block of claim 1 in which said upper section has a substantially flat portion which is positioned substantially parallel to said centrally located circular surface.

16. The improved cylindrical bottom block of claim 1 in which said upper section has a substantially flat portion which has an upward and outward slope relative to said centrally located circular surface of from about 0.01° to about 10°.

17. The improved cylindrical bottom block of claim 1 in which said upper section has a substantially flat portion which has a downward and outward slope relative to said centrally located circular surface of from about 0.01° to about 15°.

18. In a method for continuously casting ingots of aluminum, magnesium or their alloys comprising:

(a) providing an open-ended mold;

(b) providing a bottom block within said open-ended mold, said bottom block comprising:

(i) a base section having an outer diameter;

(ii) a centrally located circular surface forming the upper end of said base section, said circular surface positioned substantially perpendicular to the direction of casting, said circular surface forming a floor of a dish of a cylindrical bottom block which receives and cools liquid phase metal to form the butt end of an ingot, said circular surface being substantially flat and having a peripheral edge;

(iii) a cylindrical rim extending around said peripheral edge of said centrally located circular surface, said rim having an upper section and an inner side wall which forms the side wall of said dish;

(iv) a concave transition section positioned between said peripheral edge and the lower end of said inner side wall, said concave transition section extending completely around the peripheral edge of said dish;

(v) a convex transition section between said upper section of said rim and the upper end of said inner side wall, said convex transition section extending completely around said dish;

(vi) said inner side wall having a flat central surface extending completely around said dish and defining the inner diameter of said dish; and (vii) said upper section of said rim having a flat surface positioned substantially parallel to said centrally located circular surface, said upper section extending around said dish;

(c) substantially continuously introducing molten metal into said open-ended mold;

(d) continuously applying liquid cooling medium to said open-ended mold to effectuate at least partial solidification of the molten metal therein; and (e) continuously withdrawing said bottom block from said open-ended mold to form an ingot, said ingot having its periphery, at least, solidified, while simultaneously directing liquid cooling medium comprising water to the exterior surfaces of the ingot emerging from the mold to extract heat therefrom.

19. The method of claim 18 in which molten metal symmetrically fills said open-ended mold.

20. The method of claim 18 in which molten metal symmetrically fills said open-ended mold during the initial phases of casting.

21. The method of claim 18 in which molten metal symmetrically fills said open-ended mold during the initial phases of casting so that said molten metal does not touch said upper section of said rim.

22. The method of claim 18 in which molten metal symmnetrically fills said open-ended mold from the center of said bottom block during the initial phases of casting.

23. The method of claim 18 in which molten metal symmetrically fills said open-ended mold from the center of said bottom block during the initial phases of casting so that said molten metal does not touch said upper edge of said rim.

24. The method of claim 18 in which said bottom block is cooled to a temperature below about 212° F. prior to introducing molten metal into said open-ended mold.

25. The method of claim 18 in which said bottom block is cooled to about room temperature prior to introducing molten metal into said open-ended mold.

26. The method of claim 18 in which said bottom block is cooled to a temperature about 35° F. to about 212° F. prior to introducing molten metal into said open-ended mold.

* * * * *